US006176296B1

(12) United States Patent
Asai

(10) Patent No.: US 6,176,296 B1
(45) Date of Patent: Jan. 23, 2001

(54) APPARATUS FOR PRESSING SAND MOLDS

(75) Inventor: Hirofumi Asai, Toyokawa (JP)

(73) Assignee: Sintokogio, Ltd. (JP)

( * ) Notice: Under 35 U.S.C. 154(b), the term of this patent shall be extended for 0 days.

(21) Appl. No.: 09/316,240

(22) Filed: May 21, 1999

(30) Foreign Application Priority Data

May 22, 1998 (JP) ..... 10-141198

(51) Int. Cl.[7] ..... B22C 15/02
(52) U.S. Cl. ..... 164/207; 164/172
(58) Field of Search ..... 164/169, 170, 164/171, 172, 173, 207, 374

(56) References Cited

U.S. PATENT DOCUMENTS 994,626 * 6/1911 Winfield ..... 164/172
1,070,293 * 8/1913 Ronceray ..... 164/173
1,137,638 * 4/1915 Lang ..... 164/172
3,284,858 * 11/1966 Taccone ..... 164/171
3,589,433 * 6/1971 Hedberg ..... 164/207
4,915,159 4/1990 Damm et al. ..... 164/456

FOREIGN PATENT DOCUMENTS 3-24266 5/1991 (JP) .

* cited by examiner

*Primary Examiner*—J. Reed Batten, Jr.
(74) *Attorney, Agent, or Firm*—Limbach & Limbach, L.L.P.

(57) ABSTRACT

The apparatus includes a molding flask having at least one bar and a squeeze board having a pressing member. The pressing member has at least one vent hole, and defines at least one groove that divides the pressing member into at least two parts. Each groove is positioned and shaped such that it corresponds to the position and shape of one bar. The apparatus also includes an actuator-connecting member to which each part of the pressing member is attached, and an actuator that vertically moves each part of the pressing member.

15 Claims, 2 Drawing Sheets

APPARATUS FOR PRESSING SAND MOLDS

FIELD OF THE INVENTION

This invention relates to an apparatus for pressing a sand mold that is part of an apparatus for producing a mold.

BACKGROUND OF THE INVENTION

One known apparatus for pressing sand molds includes a squeeze board that is made of a rigid plate for pressing molding sand fed into a molding flask. However, that apparatus has a problem in that when required the pressure of the squeeze board cannot be readily varied to correspond to the shape of a pattern. Specifically, since the squeeze board is a rigid plate, although the molding sand located above the upper part of the pattern can be completely pressed, the molding sand located above the lower part of the pattern cannot he completely pressed. As a result, no uniform pressure over all the molding sand can be attained. To overcome this problem, Japanese Utility Model Publication (Kokoku) No. Hei 3-24266 discloses an apparatus for pressing sand molds wherein the squeeze board is elastic.

Also, Japanese Patent Laid-Open (Kokai) No. Hei 1-5642 discloses an apparatus for pressing sand molds wherein a plurality of squeeze heads, each operated by a hydraulic cylinder, are juxtaposed above the molding sand and directed downward such that the pressure of each squeeze head can be varied to correspond to the shape of the pattern. However, this apparatus has a problem in that since a plurality of actuators are necessary to operate each squeeze head, its cost is very high and its structure complex. This apparatus has another problem in that the squeeze head cannot press all of the molding sand near the molding flask.

SUMMARY OF THE INVENTION

This invention was made to overcome these problems. It aims to provide an apparatus for pressing sand molds that can attain a uniform pressure over all the molding sand with a simple structure and less actuators than required in the prior art.

To achieve the purposes of this invention, the apparatus for pressing a sand mold that includes a squeeze board for pressing molding sand fed to a molding flask and an actuator for operating the squeeze board is characterized by the molding flask having at least one bar that connects at least two sides of the molding flask, the squeeze board being positioned above the molding flask and comprising a pressing member and an actuator-connecting member, the pressing member being positioned below the actuator-connecting member and being divided into at least two parts by at least one groove, the groove being positioned and shaped such that it corresponds to the position and shape of the bar so that the bar can enter it, every divided part of the pressing member being attached to the actuator-connecting member, and the actuator being positioned above the squeeze board and connected to the actuator-connecting member so that the actuator vertically moves the squeeze board, thereby vertically moving every divided part of the pressing member.

Uniform pressure over all the molding sand can be attained by increasing the pressure on a sand mold. To do this, the rigidity of the molding flask that is to be put under increased pressure should be strengthened. In this invention, since the molding flask has at least one bar that connects at least two sides of the molding flask, the rigidity of the molding flask is strengthened. However, in the conventional apparatus wherein the rigid or elastic squeeze board has no groove, such a molding flask cannot be used, since the conventional squeeze board collides with the bar. Thus, the bar prevents the squeeze board from being lowered. Although to overcome this problem a plurality of squeeze heads can be used, the problem of a plurality of actuators being necessary is not overcome. In this invention, since the pressing member of the squeeze board is divided into at least two parts by at least one groove that is positioned and shaped such that it corresponds to the position and shape of the bar, the squeeze board can be lowered without colliding with the bar. Therefore, in this invention a molding flask that has a bar can be used to strengthen its rigidity. Thereby, the uniform pressure on the molding sand can be attained by increasing the pressure on the sand molds.

Also, since in this invention every divided part of the pressing member of the squeeze board is attached to the actuator-connecting member, the actuator can vertically move every divided part of the pressing member by vertically moving the squeeze board. Thus, just one actuator suffices to operate the squeeze board. Therefore, the cost of the apparatus can be lowered, and its structure can be simplified, over the prior art.

DESCRIPTION OF THE PREFERRED EMBODIMENTS

The embodiments of the invention are now explained in detail by reference to the related drawings.

Figure 1:
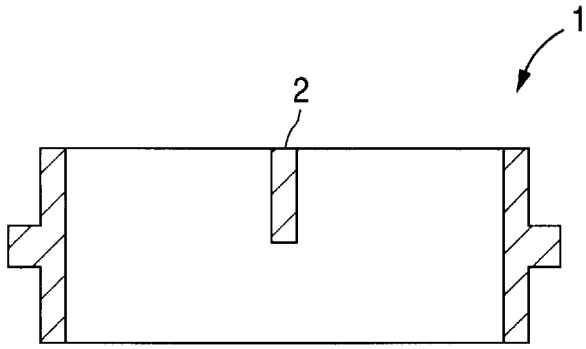
FIG. 1 is a schematic section view of the molding flask having one bar.
Figure 2:
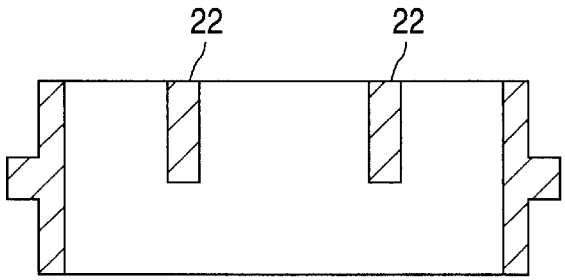
FIG. 2 is a schematic section view of an alternative molding flask having two bars.

FIGS. 1 and 2 show a section view of a molding flask 1. In FIG. 1, the molding flask 1 has one straight bar 2. It is connected to its front and back sides (not shown), to strengthen its rigidity. This bar 2 does not reach the bottom of the molding flask 1. Thus, it does not contact a pattern (not shown) mounted on a pattern plate (not shown) while sand molds are being produced. As in FIG. 2, alternatively the molding flask 1 can have two straight bars 22, each of which connects the front and back sides (not shown) of the molding flask 1.

Although in the embodiments in FIGS. 1 and 2 each bar 22 is straight-shaped in cross section, alternatively, the each bar 2,22 can form a T in cross section. Or, the bars 2,22 can form the shape of a grating in cross section. The shape of each bar 2,22 can be varied to correspond to the shape of the pattern.

Figure 3:
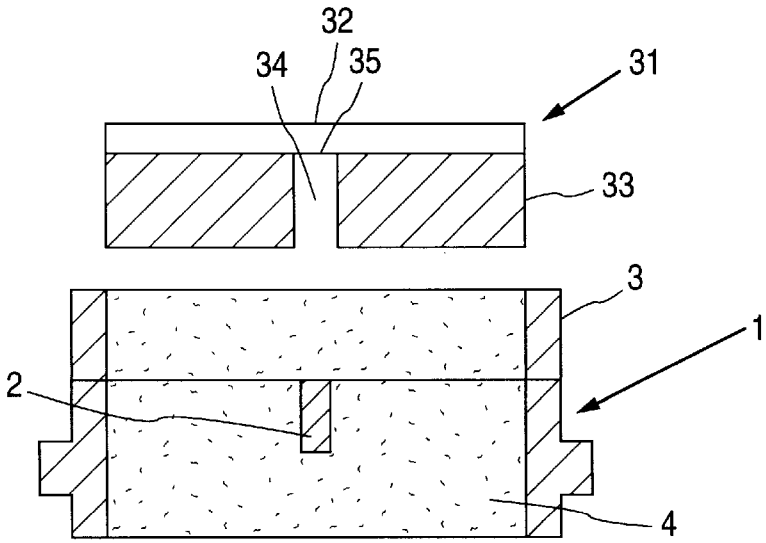
FIG. 3 is a schematic section view of the main parts of the apparatus for producing molds.

FIG. 3 shows the molding flask 1, a filling frame 3, a squeeze board 31, and molding sand 4. The squeeze board 31 comprises an actuator-connecting member 32 and a pressing member 33. The pressing member 33 is divided into two parts by a groove 34.

The groove 34 is positioned and shaped such that it corresponds to the position and shape of the bar 2. When the squeeze board 31 is lowered to press the molding sand 4, the bar 2 enters the groove 34. The depth of the groove 34 is predetermined, by the distance by which the squeeze board 31 is lowered, such that the bar 2 does not reach the inner end 35 of the groove 34 when the squeeze board 31 is lowered to its lowest level.

In this invention, as in FIG. 3, the shape of each of the two divided parts of the pressing member 33 of the squeeze board 31 is the same. However, alternatively, each shape can be varied to correspond to the shape of the pattern. Also, the material of each divided part of the pressing member 33 of the squeeze board 31 can be varied to adapt to the properties of the molding sand 4.

In this invention, rigid materials, such as synthetic resins and metals, can be used for the entire squeeze board 31. However, alternatively, elastic materials, such as rubber, can be used for the entire squeeze board 31. Or, the material used for the actuator-connecting member 32 and that used for the pressing member 33 can differ. In such a case, most preferably an elastic material is used for the pressing member 33 and a rigid material is used for the actuator-connecting member 32. By this most preferred combination of materials, both a uniform pressure on the molding sand 4 and an easy connection to an actuator 41 can be attained.

In this invention, the molding sand 4 can be of any type. However, preferably, silt is blended with the molding sand 4. For example, molding sand 4 blended with bentonite as a binder is the most preferable.

Figure 4:
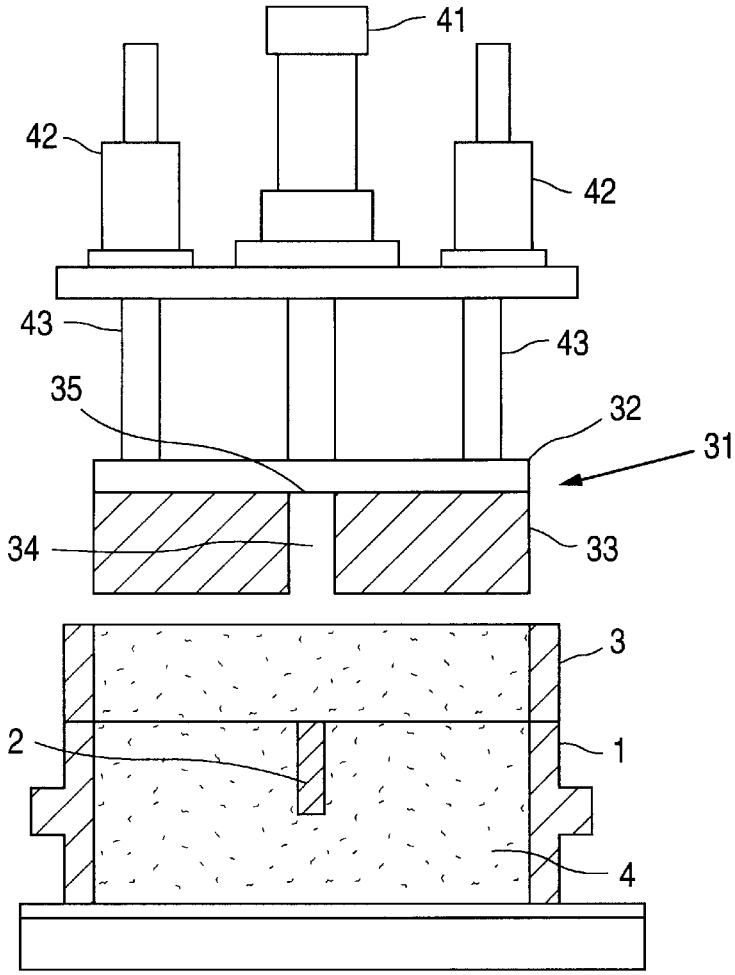
FIG. 4 is a schematic section view of the apparatus for pressing sand molds of this invention at the stage where a filling frame is mounted on a molding flask and molding sand is fed into the molding flask.

As in FIG. 4, the actuator-connecting member 32 of the squeeze board 31 is connected to the actuator 41 through rods 43. When the actuator 41 is operated, the rods 43 are extended to vertically move the actuator-connecting member 32, thereby vertically moving the pressing member 33. Each guide member 42 covers a part of a respective rod 43. The width of the inside diameter of each guide member 42 is selected so that it can guide the vertical extension of the rod 43.

In this invention, the actuator 41 can be a motor-driven, hydraulic, or pneumatic cylinder.

In this invention, the pressing member 33 of the squeeze board 31 has no vent hole. Sand molds with a uniform rigidity can be produced by this apparatus alone, depending on the shape of the sand mold. However, alternatively, sand molds with a more uniform rigidity can be produced by adding means to fill the molding sand 4 by means of a force of air such as air flow molding and air impact molding. In such a case, by providing at least one vent hole in the pressing member 33 of the squeeze board 31, air can be caused to flow not only from the periphery of, but also from the center of, the squeeze board 31. Thereby, an air flow molding can be effected.

Next, the operation of the apparatus of this invention to press sand molds is explained.

Figure 5:
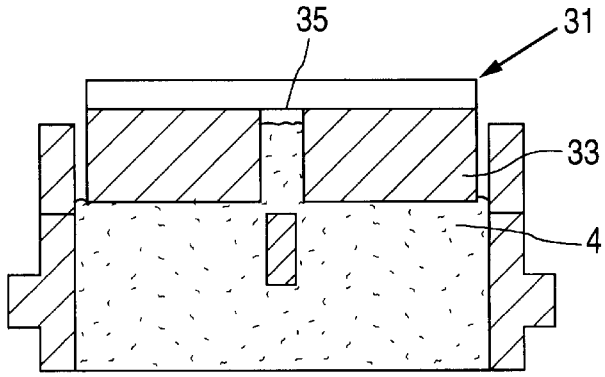
FIG. 5 is a schematic section view of the apparatus for pressing sand molds of this invention at the stage where the squeeze board is lowered to press the molding sand.

As in FIG. 4, the filling frame 3 is mounted on the molding flask 1, and the molding sand 4 is fed to the molding flask 1 and the filling frame 3. The apparatus for pressing sand molds that is supported by a frame (not shown) is positioned above the molding flask 1. When the actuator 41 is operated, the rods 43 are extended to vertically lower the squeeze board 31. Thereby, every divided part of the pressing member 33 is vertically lowered to press the molding sand 4. As in FIG. 5, when the pressing member 33 is further lowered to press the molding sand 4, the bar 2 enters the groove 34. The depth of the groove 34 is predetermined such that the bar 2 does not reach the inner end 35 of the groove 34 when the pressing member 33 is lowered to its lowest level.

As is seen from the above description, the apparatus for pressing a sand mold of this invention includes a molding flask having at least one bar that connects at least two sides of a molding flask. Thus, the rigidity of the molding flask can be strengthened. Therefore, a uniform pressure on the molding sand can be attained by increasing the pressure on the sand mold.

Also, since in this invention the pressing member of the squeeze board is divided by at least one groove that is positioned and shaped such that it corresponds to the position and shape of the bar, the squeeze board can be vertically lowered without colliding with the bar.

Also, since in this invention every divided part of the pressing member is attached to the actuator-connecting member, the actuator can vertically move every divided part of the pressing member by vertically moving the squeeze board. Thus, just one actuator suffices to move every divided part of the pressing member. Therefore, the cost of the apparatus can be lowered and its structure can be simplified, over the prior art.

What is claimed is:

1. An apparatus for pressing a sand mold for air-flow molding and air-impact molding, comprising:

a squeeze board for pressing molding sand fed to a molding flask and an actuator for operating the squeeze board; and a molding flask having at least one bar that connects at least two sides of the molding flask, the squeeze board being positioned above the molding flask and comprising a pressing member and an actuator-connecting member; wherein the pressing member has at least one vent hole, is positioned below the actuator-connecting member and defines at least one groove which divides said pressing member into at least two pans, the groove being positioned and shaped such that it corresponds to the position and shape of the bar so that the bar can enter it, each of the parts of the pressing member being attached to the actuator-connecting member, and the actuator being positioned above the squeeze board and connected to the actuator-connecting member so that the actuator vertically moves the squeeze board, thereby vertically moving each of the parts of the pressing member.

2. The apparatus of claim 1, wherein the pressing member of the squeeze board is rigid.

3. The apparatus of claim 1, wherein the pressing member of the squeeze board is elastic.

4. The apparatus of claim 1, wherein the connecting member of the squeeze board is rigid.

5. The apparatus of claim 1, wherein the connecting member of the squeeze board is elastic.

6. The apparatus of claim 1, 2, 3, 4, or 5, wherein the bar is positioned so as to connect any two opposite sides of the molding flask.

7. The apparatus of claim 1, 2, 3, 4, or 5, wherein the bar is positioned so as to be spaced apart from a pattern on a pattern plate.

8. The apparatus of claim 1, 2, 3, 4, or 5, wherein the bar is straight in cross section.

9. The apparatus of claim 1, 2, 3, 4, or 5, wherein the bars form a T in cross section.

10. The apparatus of claim 1, 2, 3, 4, or 5, wherein the bars form the shape of a grating in cross section.

11. The apparatus of claim 1, 2, 3, 4, or 5, wherein the depth of the groove is predetermined such that the bar does not reach the inner end of the groove when the squeeze board is lowered to its lowest level.

12. The apparatus of claim 11, wherein the material of each divided part of the pressing member of the squeeze board is varied to adapt to the properties of the molding sand.

13. The apparatus of claim 1, 2, 3, 4, or 5, wherein the shape of each of the parts of the pressing member of the squeeze board is varied to correspond to the shape of a pattern.

14. The apparatus of claim 13, wherein the material of each divided part of the pressing member of the squeeze board is varied to adapt to the properties of the molding sand.

15. The apparatus of claim 1, 2, 3, 4, or 5, wherein the material of each divided part of the pressing member of the squeeze board is varied to adapt to the properties of the molding sand.

* * * * *

UNITED STATES PATENT AND TRADEMARK OFFICE

CERTIFICATE OF CORRECTION

PATENT NO. : 6,176,296 B1

DATED : Jan. 23, 2001

INVENTOR(S) : Asai

It is certified that error appears in the above-identified patent and that said Letters Patent is hereby corrected as shown below:

In Claim 1, column 4, line 36 change "pans" to --parts--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*